US006838962B2

(12) United States Patent
Leone et al.

(10) Patent No.: US 6,838,962 B2
(45) Date of Patent: Jan. 4, 2005

(54) WIRE LUG/ARC VENT BARRIER MOLDED CASE CIRCUIT BREAKER

(75) Inventors: David A. Leone, Lilburn, GA (US); Steve D. Still, Loganville, GA (US)

(73) Assignee: Siemens Energy and Automation, Inc., Alpharetta, GA (US)

( * ) Notice: Subject to any disclaimer, the term of this patent is extended or adjusted under 35 U.S.C. 154(b) by 0 days.

(21) Appl. No.: 10/431,014

(22) Filed: May 7, 2003

(65) Prior Publication Data

US 2003/0201858 A1 Oct. 30, 2003

Related U.S. Application Data

(62) Division of application No. 09/826,339, filed on Apr. 4, 2001, now Pat. No. 6,624,375.

(51) Int. Cl.[7] ..... H01H 9/02
(52) U.S. Cl. ..... 335/202; 335/16
(58) Field of Search ..... 335/23–25, 165–176, 335/201–202; 439/810–814; 218/151–158, 77–81, 22, 148–150

(56) References Cited

U.S. PATENT DOCUMENTS

| | | | | |
|---|---|---|---|---|
| 4,905,122 A | | 2/1990 | Culnan et al. | |
| 5,107,396 A | | 4/1992 | Rosen et al. | |
| 5,301,086 A | | 4/1994 | Harris et al. | |
| 5,488,337 A | | 1/1996 | Hubbard et al. | 335/202 |
| 5,753,877 A | * | 5/1998 | Hartzel et al. | 218/157 |
| 5,772,479 A | | 6/1998 | Fleege et al. | 439/801 |
| 5,811,749 A | | 9/1998 | Bausch et al. | 218/157 |
| 5,831,498 A | | 11/1998 | Maloney et al. | 335/8 |

* cited by examiner

*Primary Examiner*—Lincoln Donovan
(74) *Attorney, Agent, or Firm*—Foley & Lardner LLP

(57) ABSTRACT

The present invention provides a wire lug arc vent barrier for protecting a wire lug in a molded case circuit breaker, with the circuit breaker having a housing with a terminal for a load connection and a terminal for a line connection. The wire lug/arc vent barrier comprises a body having a first end including a tang, a second end including an elongated finger and a middle portion between the first end and the second end defining a concave space, with an opening at each of the middle portion, wherein the body is mounted in the housing.

5 Claims, 2 Drawing Sheets

10
12
14
18
20
21
22
23
24
26
28
29
30
32
40
43
44
45
52
66
68
70
72
73
74
80
86
92
100
3
4
CABLE
WIRE

WIRE LUG/ARC VENT BARRIER MOLDED CASE CIRCUIT BREAKER

This is a Divisional Application of application Ser. No. 09/826,339, filed Apr. 4, 2001, now U.S. Pat. No. 6,624,375, issued Sep. 23, 2003.

FIELD OF INVENTION

The present invention relates generally to the field of circuit breakers, and more particularly to a wire lug/arc vent barrier for a molded case circuit breaker.

BACKGROUND OF THE INVENTION

In general the function of a circuit breaker is to electrically engage and disengage a selected circuit from an electrical power supply. This function occurs by engaging and disengaging a pair of operating contacts for each phase of the circuit breaker. The circuit breaker provides protection against persistent overcurrent conditions and against the very high currents produced by short circuits. Typically, one of each pair of the operating contacts are supported by a pivoting contact arm while the other operating contact is substantially stationary. The contact arm is pivoted by an operating mechanism such that the movable contact supported by the contact arm can be engaged and disengaged from the stationary contact.

A typical industrial circuit breaker will have a continuous current rating ranging from as low as 15 amps to as high as several thousand amps. The tripping mechanism for the breaker usually consists of a thermal overload release and a magnetic short circuit release. The thermal overload release operates by means of a bimetallic element, in which current flowing through the conducting path of a circuit breaker generates heat in the bi-metal element, which causes the bi-metal to deflect and trip the breaker. The heat generated in the bi-metal is a function of the amount of current flowing through the bi-metal as well as the period of time that that current is flowing. For a given range of current ratings, the bi-metal cross-section and related elements are specifically selected for such current range resulting in a number of different current ranges for each circuit breaker. Electronic trip units are also used in some applications.

In the event of current levels above the normal operating level of the thermal overload release, it is desirable to trip the breaker without any intentional delay, as in the case of a short circuit in the protected circuit, therefore, an electromagnetic trip element is generally used. In a short circuit condition, the higher amount of current flowing through the circuit breaker activates a magnetic release which trips the breaker in a much faster time than occurs with the bi-metal heating. It is desirable to tune the magnetic trip elements so that the magnetic trip unit trips at lower short circuit currents at a lower continuous current rating and trips at a higher short circuit current at a higher continuous current rating. This matches the current tripping performance of the breaker with the typical equipment present downstream of the breaker on the load side of the circuit breaker. Again, electronic trip units can also be used.

Ratings of circuit breakers are continually increasing due to market driven requirements for space saving electrical equipment. As the ampere rating for a given circuit breaker frame size increases, space for wiring lugs within that circuit breaker becomes a premium. Lug size for attaching the various wires and cables is primarily driven by the wiring cable dimensions as defined in the National Electric Code or other country specific wiring standards or practices.

Although this problem exists for all circuit breakers, it is especially acute for circuit breakers in the 100 amp to 125 amp range. In addition, the location of the wire lugs in the circuit breaker generally occupies the same relative space as the arc venting area near the main contacts. As the main contacts separate under an overload or short circuit condition, heat, gases, and arc by-products which are generated by the arcing in the arc chamber must vent out of the circuit breaker's housing. Such out gassing typically envelopes the wire lug and cabling near the arc chamber of the circuit breaker. The close proximity of the wire lug, and the load and line terminals with the contact of the circuit breaker create additional space limitations because of insulation requirements. Prior arrangements to address such problems include providing larger housing for the circuit breaker to accommodate the thicker insulations and larger wire lugs and cables. Prior arrangements also included requiring additional gas venting deflectors. Such prior arrangements are more expensive and complex in relation to the benefits sought and not as effective or reliable.

Thus, there is a need for a molded case circuit breaker having a wire lug/arc vent barrier for protecting a wire lug in a circuit breaker utilizing a stacked pole construction. There is also a need for a wire lug/arc vent barrier that will direct arc gasses and by-products around the wire lug and wire binding screw. There is further need for a wire lug/arc vent barrier that incorporates the functions of a lug barrier, arc chamber venting and line end insulation system in a single integral molded piece. There is further need for a wire lug/arc vent barrier for a molded case circuit breaker that allows the ampere rating of the breaker to be increased without increasing the overall size of the circuit breaker. There is additional need for a wire lug/arc vent barrier for a molded case circuit breaker that provides for easy assembly and mounting within the circuit breaker housing.

SUMMARY OF THE INVENTION

The present invention provides a wire lug/arc vent barrier for protecting a wire lug in a circuit breaker, with the circuit breaker having a housing with a terminal for a load connection and a terminal for a line connection. The wire lug/arc vent barrier comprises a body having a first end including a tang, a second end including an elongated finger and a middle portion between the first end and the second end defining a concave space, with an opening at each end of the middle portion, wherein the body is mounted in the housing. Another embodiment of the wire lug/arc vent barrier provides the tang and elongated finger configured to engage the housing and the concave space is configured to receive the wire lug. The middle portion is configured to direct arc gases around and away from the wire lug. Another embodiment of the barrier provides that the first end, the second end and the middle portion are molded as a single, integral piece. Another embodiment provides that the body is composed of a dielectric material.

The present invention further provides a molded case circuit breaker comprising a molded case including a main cover, a first terminal and second terminal inserted in the case, a first contact electrically and mechanically coupled to the first terminal, and a second contact electrically and mechanically connected to the second terminal. An operating mechanism having a pivoting member movable between and ON position, an OFF position, and a TRIPPED position, wherein the pivoting member is coupled to the second contact. A trip unit coupled to the second contact and the second terminal with the trip unit in selective operative contact with the operating mechanism. An electric arc extinguishing apparatus is mounted in the housing and is positioned in confronting relation with the first and second contacts. A wire lug/arc vent barrier is coupled to the terminals. The barrier comprises a body having a first end including a tang, a second end including an elongated finger, and a middle portion between the first end and the second end defining a concave space, with an opening at each end of the middle portion, wherein the body is mounted in the housing. Another embodiment provides that the tang and elongated finger are configured to engage the housing and the concave spaces configured to receive a wire lug. Another embodiment provides that the middle portion is configured to direct arc gases around and away from the wire lug. Another embodiment provides wherein the first end, the second end and the middle portion are molded as a single, integral piece. Another embodiment provides wherein the body is composed of a dielectric material.

The present invention further provides a circuit breaker comprising a molded housing including a base. A means for connecting a load to the circuit breaker, mounted in the housing, a means for connecting an electrical line to the circuit breaker, and a means for coupling electrically to the means for connecting an electrical line. A movable means for contacting the means for connecting an electrical line to a means for operating mounted in the housing is coupled with the means for operating having a pivoting member movable between an ON position, an OFF position and a TRIPPED position. The pivoting member is coupled to the movable means for contacting and with the means for operating. A means for tripping is coupled to the movable means for contacting and the means for connecting the load with the means for operating. The means for tripping includes a means for releasing under a short circuit condition and a means for releasing under an overload condition. A means for extinguishing an electric arc is mounted in the housing with a movable means for contacting extended into the means for extinguishing. A means for shielding the means for connecting the load and line is mounted in the housing. Another embodiment provides that the means for shielding includes a tang and an elongated finger configured to engage the housing and a middle portion defining a concave space configured to receive a wire lug. Another embodiment provides where the middle portion is configured to direct arc gases around and away from the wire lug. It is also provided wherein the means for shielding is a single, integral piece of material. Another embodiment provides for the means of shielding to be a molded piece which can also be composed of a dielectric material.

The present invention further provides a method of assembling a wire lug/arc vent barrier system for a molded case circuit breaker having a housing with a load terminal, a line terminal, an operating mechanism connected to the line terminal, and a trip unit coupled to the operating mechanism and a load terminal. The method comprises the steps of providing a wire lug/arc vent barrier having a body, a first end including a tang, a second end including an elongated finger and a middle portion between the first end and the second end finding a concave space with an opening at each end of the middle portion. The method also includes providing a wire lug and installing the wire lug in the concave space. Then installing the wire lug/arc vent barrier and installed wire lug in the housing circuit breaker and securing the wire lug arc vent barrier and installed wire lug in the housing and one of the line terminal and load terminal.

DETAILED DESCRIPTION OF THE PREFERRED EMBODIMENTS

Figure 1:
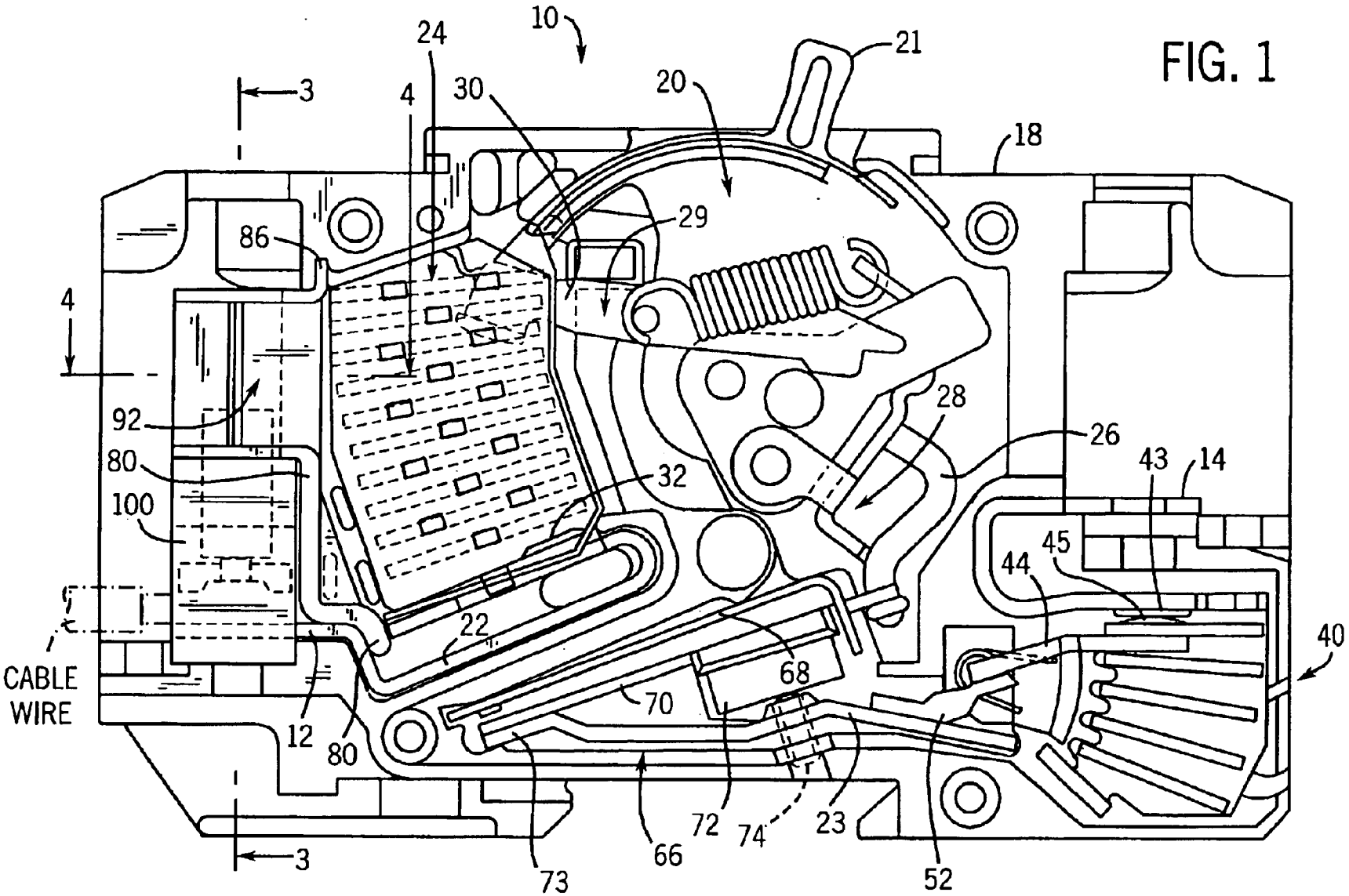
FIG. 1 is a side cut-away view of a molded case circuit breaker providing an exemplary embodiment of a wire lug/arc vent barrier mounted in the housing at the line terminal.

FIG. 1 generally illustrates single phase molded case circuit breaker 10 that includes an operating mechanism 20 having a handle 21. The operating mechanism 20 is mounted within a housing 18. The handle 21 is movable between an "ON" position, an "OFF" position and a "TRIPPED" position. The exemplary circuit breaker 10 is a single pole breaker however, it is contemplated that the several exemplary embodiments of the wire lug/arc vent barrier 80 may be practiced in a three-phase or in other multi-phase circuit breakers. In such multi-phase breaker, each pole would have its own wire lug/arc vent barrier 80 aligned in the one of the line terminal 12 and load terminal 14 as dictated by the specific circuit breaker design. It is also contemplated to use an embodiment of the wire lug/arc vent barrier 80 in a circuit breaker having an auxiliary contact apparatus 40 as shown in FIG. 1.

The molded case circuit breaker 10 has a line terminal 12 and a load terminal 14 to which electrical wires or cables are attached when the circuit breaker 10 is installed in a selected circuit. The housing 18 encloses the components of the circuit breaker including an operating mechanism 20 to which a main movable contact arm 30 and a trip assembly 28 are coupled.

An auxiliary contact apparatus 40 can be mounted within a suitable void in the housing 18 of the circuit breaker 10 and coupled in series with the main movable contact arm 30. It is contemplated that an existing molded case circuit breaker will be minimally modified to accommodate the auxiliary contact apparatus 40. However, it is also contemplated that a new molded case circuit breaker design case initially incorporate the auxiliary contact apparatus 40.

A bi-metal/magnetic trip assembly 66 is mounted in the housing 18 of the circuit breaker 10 and couples the load bus 23 to the main movable contact arm 30 via a main braid 26 through the bi-metal. The bi-metal assembly includes the bi-metal element 70 fixed at one end to the load bus 23 at a joint 73 formed by the load bus 23 and the bi-metal 70. The joint 73 is created by suitable weld or braze. A magnetic armature 68 and a magnetic yoke 72 form a part of the bi-metal assembly 66. The response characteristics of the bi-metal/magnetic trip assembly 66 is controlled by a calibrating screw 74 mounted in the load bus 23 and by the physical attributes of the trip assembly.

In operation, with the circuit breaker 10 in the ON position, the main movable contact arm 30 and main stationary contact 32 are closed. In such condition, the current flows through the line terminal 12 into the line bus 22 and through the main stationary contact 32 into the main movable contact arm 30 of the primary contact apparatus 29. The current then flows through the main braid 26 into the bi-metal/magnetic trip assembly 66 and then through the load bus 23 through the load terminal 14 and onto the load (not shown). In the event that an auxiliary contact apparatus 40 is utilized, the current would flow from the load bus 23, through the auxiliary braid 52 into the auxiliary movable contact arm 44 and into the auxiliary movable contact arm contact pad 45 to the auxiliary stationary contact pad 43, and into the load terminal 14.

Under a short circuit condition, the circuit breaker 10 will experience high current flowing through the circuit described above. Such high current will cause the magnetic yoke 72 and the magnetic armature 68 in the bi-metal/magnetic trip assembly 66 to activate the trip assembly 28 of the circuit breaker 10.

The electrical arc typically created during the opening of the contacts 30, 32 under short circuit conditions, is drawn into an arc chute structure 24 which extends and cools the arc to assist in the current interruption operation of the circuit breaker. The main movable contact on arm 30 and the main stationary contact 32 are blown apart by the magnetic force generated under the short circuit condition. The operating mechanism 20, trip assembly 28 and the bi-metal assembly 66 of the circuit breaker 10 also operates to hold the main movable contact arm 30 in its TRIPPED and OPENED position. With the circuit opened, the main movable contact arm 30 remains in an open position until the handle 21 of the circuit breaker 10 is reset and placed in the ON position. This can be done manually by an operator or can be done by a motor coupled to the circuit breaker or by a stored energy device coupled to the circuit breaker.

An arc chute structure 24 includes two arch chute side panels having a plurality of slots support a plurality of arc plates (See FIG. 1). The arc plates, as best seen in FIG. 1, are generally U-shaped and are stacked between the two side plates. The arc plates can be provided with tabs which engage the slots to form the arc chute structure. In the stacked position, as shown in the figures, an arc channel is formed between the two legs of each arc plate. When inserted into the housing 18 of the circuit breaker 10, the arc chute structure 24 is aligned with the movable contact arm 30 of the operating mechanism 20. The movable contact arm 30 moves through the channel of the arc chute structure 24 as the movable contact arm 30 moves from one position to another position. During a short circuit condition, as the movable contact arm 30 opens an electrical arc is drawn between the contact pads of the contact arm 30 and the stationary contact 32. Such electric arc extends into the arc chute structure 24 which lengthens and cools the arc as the arc voltage increases until the current ceases to flow in the circuit. An arc runner can also be provided on the movable contact arm to facilitate the extension, into the arc channel, of the arc generated during a short circuit condition. The arc runner can be integrally formed with the movable contact arm during the manufacture of the contact apparatus.

In order to increase the current rating of the circuit breaker 10, the circuit breaker must accommodate the large cables wires used to connect the circuit breaker to the circuit being protected. The National Electrical Code and other countries' specific wiring standards or practices specifies the size and diameter of the cables and wires to be used at specific current levels. It is necessary to provide a barrier between the lug and the housing of the circuit breaker as well as to protect the lug and cable from the arc chamber venting gases generated during operation of the circuit breaker, particularly in short circuit condition. In addition, it is also necessary to insulate the wire lug end cables, particularly in a multi-pole breaker arrangement to prevent locking between poles as the circuit breaker operates to break the circuit.

Figure 2:
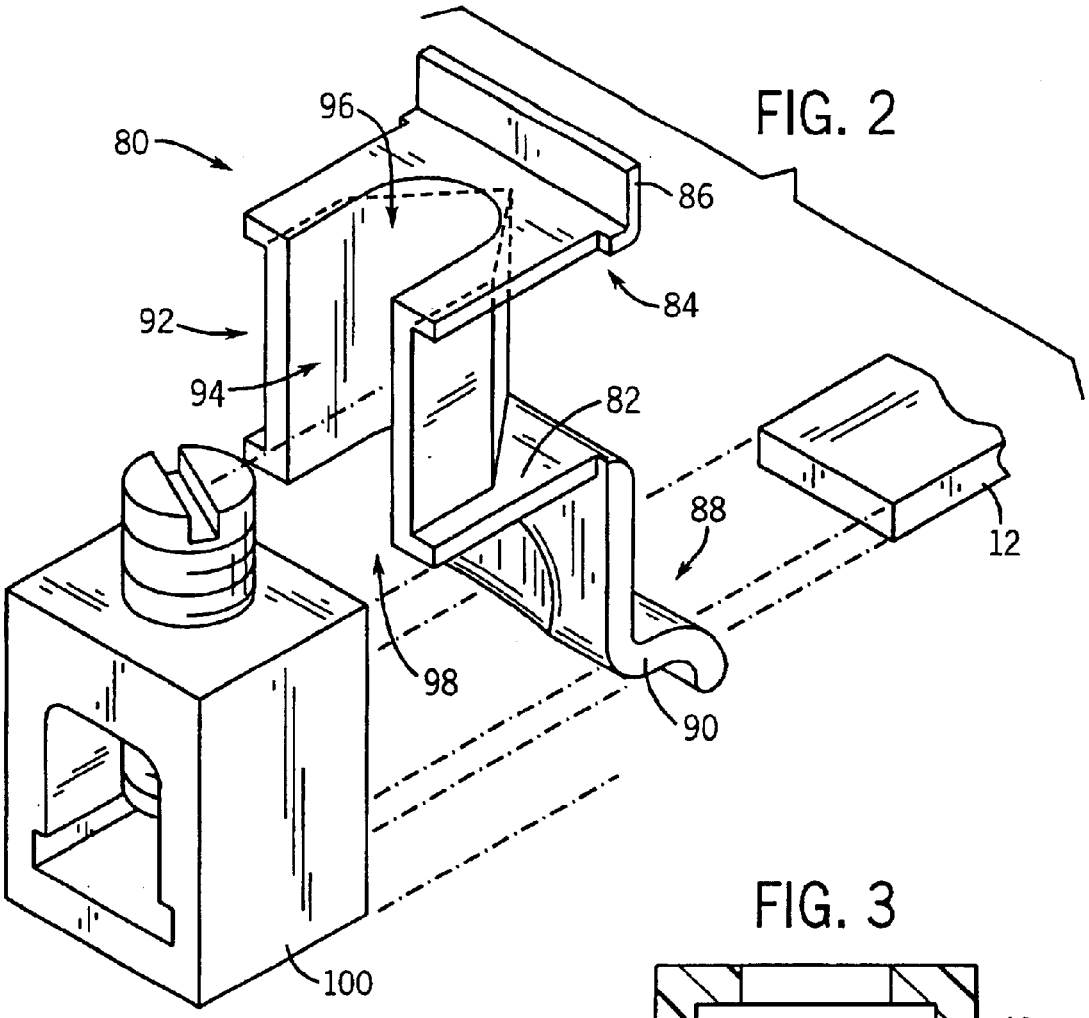
FIG. 2 is a perspective illustration of an exemplary embodiment of a wire lug/arc vent barrier and wire lug.
Figure 3:
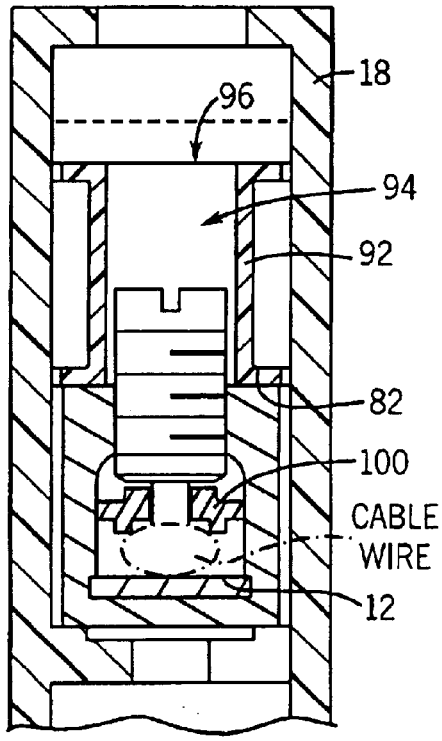
FIG. 3 is a sectional view of an exemplary embodiment of a wire lug/arc vent barrier along the lines 3—3, as shown in FIG. 1.
Figure 4:
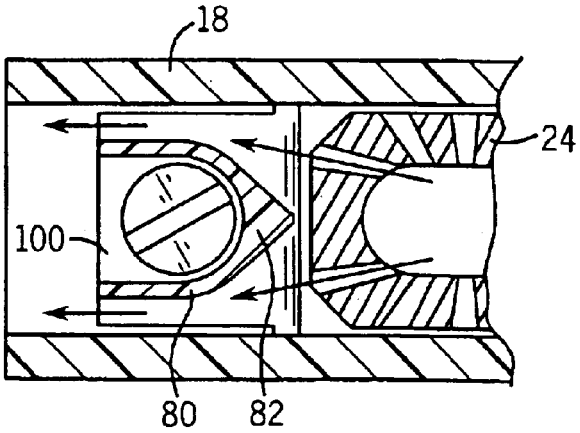
FIG. 4 is a partial sectional view of an exemplary embodiment of a wire lug/arc vent barrier along the lines 4—4, as shown in FIG. 1 and illustrating the deflection of arc gases around and away from the wire lug.

The present wire lug/arc vent barrier 80 for protecting a wire lug 100 in a circuit breaker 10 is utilized for such purposes (See FIGS. 2 and 3). In a circuit breaker 10 having a housing 18 with a terminal for a load connection 14 and a terminal for a line connection 12 including a wire lug/arc vent barrier 80 for protecting the wire lug 100 in the circuit breaker 10. The barrier 80 comprises a body 82 having: a first end 84 including a tang 86, a second end 88 including an elongated finger 90 and a middle portion 92 between the first end 84 and the second end 88 defining a concave space 94 with an opening 96, 98 at each end 84, 88 of the middle portion 92, wherein the body 82 is mounted in the housing 18, of the circuit breaker 10. The elongated finger 90 can be straight or configured with one or more steps as illustrated in FIG. 2. The tang 86 and the elongated finger 90 are configured to engage the housing 18 and the concave space 94 is configured to receive the wire lug 100. In the barrier 80, the middle portion 92 can be configured to direct arc gases around and away from the wire lug 100 (See FIG. 4). The cylindrical shaped middle portion 92 of the body 82 which defines the concave space 94 directs the gases generated in the arc chamber 24 as the circuit breaker 10 operates under short circuit conditions.

One exemplary embodiment of the wire lug/arc vent barrier 80 provides that the first end 84, the second end 88 and the middle portion 92 are molded as a single, integral piece. A dielectric material can be used for insulating the body 82. It is also contemplated that the body can be formed through a machining process or a procedure that connects the first end 84, the second end 88 and the middle portion 92 of the body 82 with an appropriate adhesive such as an epoxy. It is contemplated that the body 82 material can be an engineered plastic having appropriate electrical insulative characteristics and strength for use in the intended circuit breaker.

To assemble a wire lug/arc vent barrier system 84 for a molded case circuit breaker 10, having a housing 18 with a load terminal 14, a line terminal 12, an operating mechanism 20 connected to the line terminal 12, may have an intermediate latching mechanism, and selective contact with the operating mechanism 20, a trip unit 28 coupled to the operating mechanism and the load terminal 14 includes the steps of: providing a wire lug/arc vent barrier 80 having a body 82, a first end 84 including a tang 86, a second end 88 including an elongated finger 90 which can include a step and a middle portion 92 between the first end 84 and the second end 88 defining a concave space 94 with an opening 96, 98 and each end 84, 88 of the middle portion 92; providing a wire lug 100; installing the wire lug 100 in the concave space 94; installing the wire lug/arc vent barrier 80 and installed wire lug 100 in the housing 18 of the circuit breaker 10 and the securing wire lug/arc vent barrier 80 and installed wire lug 100 in the housing 18 and one of the line terminal 12 and load terminal 18. The tang 86 and the elongated finger 90 can be configured to engage the housing 18. Such engagement can be accomplished by inserting the tang 86 and elongated finger 90 into pockets molded in the housing 18 of the circuit breaker 10 or abutting the tang 86 and the elongated finger 90 against tabs conveniently molded in the housing 18 of the circuit breaker 10.

Arc gases generated during an operation of the circuit breaker are directed by the middle portion 92 of the body 82 of the wire lug/arc vent barrier 80 around and away from the wire lug 100 and the cable or wires connected to the wire lug 100. The wire lug/arc vent barrier 80 is maintained in the housing when the two halves of the molded case circuit breaker housing are assembled. The wire lug/arc vent barrier 80 can be molded as a single integral piece of dielectric material formed to include the first end 84, the second end 88 and the middle portion 92 of the body 82.

Thus, there is provided a circuit breaker with a line terminal and a load terminal, having an operating mechanism with a main movable contact arm coupled to a load terminal and a wire lug/arc vent barrier for protecting a wire lug in the circuit breaker. While the embodiments illustrated in the figures and described above are presently preferred, it should be understood that these embodiments are offered by way of example only. The invention is not intended to be limited to any particular embodiment, but is intended to extend to various modifications that nevertheless fall within the scope of the appended claims. For example, it is also contemplated that the trip mechanism can include an intermediate latching mechanism and can be an electronic mechanism or that the load terminal can be housed in a separate housing capable of mechanically and electrically connecting to another housing containing the operating mechanism and line terminal with the wire lug/arc vent barrier thereby providing for a quick and easy change of current rating for an application of the circuit breaker contemplated herein. It is also contemplated that the wire lug/arc vent barrier can be used in a multi-phase molded case circuit breaker which may include a separate auxiliary contact apparatus provided in series with each pole of the multi-pole circuit breaker. Additional modifications will be evident to those with ordinary skill in the art.

What is claimed is:

1. A molded case circuit breaker comprising:

a molded case including a main cover;

a first terminal and a second terminal inserted in the case;

a first contact electrically coupled to the first terminal;

a second contact electrically coupled to the second terminal;

an operating mechanism having a pivoting member moveable between an ON position, an OFF position and a TRIPPED position, wherein the pivoting member is coupled to the second contact;

a trip unit coupled to the second contact and the second terminal with the trip unit in selective operative contact with the operating mechanism;

an electric arc extinguishing apparatus mounted in the housing and positioned in confronting relation with the first and second contacts; and, a wire lug/arc vent barrier coupled to the terminal, the barrier comprising:

a body having:

a first end including a tang, a second end including an elongated finger, wherein the tang and finger are configured to engage the housing, and a middle portion between the first end and the second end defining a concave space configured to receive the wire lug and is configured to direct arc gases around and away from the wire lug, with an opening at each end of the middle portion, wherein the body is mounted in the housing.

2. The circuit breaker of claim 1, wherein the first end, the second end and the middle portion are molded as a single, integral piece.

3. The circuit breaker of claim 1, wherein the body is composed of a dielectric material.

4. A method of assembling a wire lug/arc vent barrier system for a molded case circuit breaker having a housing with a load terminal, a line terminal, an operating mechanism connected to the line terminal, a trip unit coupled to the operating mechanism and the load terminal, the method comprising the steps of:

providing a wire lug/arc vent barrier having a body, a first end including a tang, a second end including an elongated finger wherein the tang and elongated finger are configured to engage the housing, and a middle portion between the first end and the second end defining a concave space configured to receive a wire lug and is configured to direct arc gases around and away from the wire lug, with an opening at each end of the middle portion;

providing a wire lug;

installing the wire lug in the concave space;

installing the wire lug/arc vent barrier and installed wire lug in the housing of the circuit breaker; and securing the wire lug/arc vent barrier and installed wire lug to the housing and one of the line terminal and load terminal.

5. The method of claim 4, wherein the first end, the second end and the middle portion are molded as a single, integral piece of dielectric material.

* * * * *